US008477951B2

(12) United States Patent
Jung et al.

(10) Patent No.: US 8,477,951 B2
(45) Date of Patent: Jul. 2, 2013

(54) FRONT SURROUND SYSTEM AND METHOD OF REPRODUCING SOUND USING PSYCHOACOUSTIC MODELS

(75) Inventors: Chi-ho Jung, Seoul (KR); Sun-min Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1585 days.

(21) Appl. No.: 11/693,835

(22) Filed: Mar. 30, 2007

(65) Prior Publication Data

US 2007/0286427 A1 Dec. 13, 2007

(30) Foreign Application Priority Data

Jun. 8, 2006 (KR) ..... 10-2006-0051240

(51) Int. Cl.
*H04R 5/00* (2006.01)

(52) U.S. Cl.
USPC ..... 381/18; 381/99

(58) Field of Classification Search
USPC ..... 381/1, 2, 17–23, 61, 63, 300, 98, 381/28, 103, 104, 307, 99
See application file for complete search history.

(56) References Cited

U.S. PATENT DOCUMENTS

| | | | | |
|---|---|---|---|---|
| 5,680,464 | A * | 10/1997 | Iwamatsu | 381/18 |
| 8,345,892 | B2 * | 1/2013 | Jung et al. | 381/98 |
| 2007/0019812 | A1 * | 1/2007 | Kim | 381/17 |
| 2009/0060237 | A1 * | 3/2009 | Konagai et al. | 381/307 |

* cited by examiner

*Primary Examiner* — Lao Lun-See
(74) *Attorney, Agent, or Firm* — Stanzione & Kim, LLP

(57) ABSTRACT

A front surround reproduction system improving the stereo effect of mid and low frequency signals by using a psychoacoustic model, and a method thereof. An audio reproducing system to reproduce multi-channel audio signals by using a plurality of speakers includes a split unit to copy the input multi-channel signals and to split the signals into two groups of multi-channel signals, a virtual sound processing unit to generate a virtual sound signal based on a head related transfer function (HRTF) from the one group of the multi-channel signals split in the split unit, a beam forming processing unit to generate a sound beam signal by adjusting the delays and levels of the multi-channel signals belonging to the other group split in the split unit, and a crossover network unit to adjust the characteristics of the virtual sound signal and the sound beam signal generated in the virtual sound processing unit and the beam forming processing unit, respectively, and to provide the virtual sound signal and the sound beam signal to mid and low frequency speaker arrays and high frequency speaker arrays, respectively.

20 Claims, 5 Drawing Sheets

FRONT SURROUND SYSTEM AND METHOD OF REPRODUCING SOUND USING PSYCHOACOUSTIC MODELS

CROSS-REFERENCE TO RELATED APPLICATIONS

This application claims the benefit under 35 U.S.C. 119 §(a) from Korean Patent Application No. 10-2006-0051240, filed on Jun. 8, 2006, in the Korean Intellectual Property Office, the disclosure of which is incorporated herein in its entirety by reference.

BACKGROUND OF THE INVENTION

1. Field of the Invention

The present general inventive concept relates to a front surround sound reproduction system using an array of speakers, and more particularly, to a front surround reproduction system to improve a stereo effect of mid and low frequency signals by using a psychoacoustic model and a method thereof.

2. Description of the Related Art

A conventional front surround sound reproduction system employs a sound projector technology that provides a stereo effect using an array of front speakers without side and back speakers.

That is, by using the speaker array, the front surround sound reproduction system forms a sound beam from a surround channel signal, and projects the sound beam onto a wall so that sound reflected from the wall reaches a listener.

Accordingly, the listener feels a surround sound stereo effect as if the sound comes from side and back speakers, due to the reflected sound.

However, though a high frequency signal is formed as a sound beam, mid and low frequency signals are not formed as sound beams due to physical constraints and therefore are reproduced as the original signals through the front speaker array.

Accordingly, the front surround signal reproduction system cannot generate a stereo surround sound comparable to a sound signal of a home theater system using side and back speakers.

Accordingly, a variety of technologies have been introduced to solve the problem of how the conventional front surround reproduction system cannot easily generate a beam from mid and low frequency signals.

A technology related to this front surround reproduction system is disclosed in WO 04/075601 filed on Sep. 2, 2004, entitled "Sound Beam Loudspeaker System."

FIG. 1A is block diagram of a conventional front surround sound reproduction system.

A multi-channel audio signal is decoded into a left channel signal (L), a right channel signal (R), a center channel signal (C), a surround channel signal, and a low frequency effect channel signal (LFE).

The decoded signals are input to a crossover system 410, and gains of the decoded signals are adjusted appropriately by a gain adjustment unit 411. Accordingly, a high pass filter 412 and a low pass filter 413 separate n surround channel signals and L, R, and C channel signals into a high frequency band and a mid and low frequency band, respectively. The separated high frequency signal is provided to an array of speakers to perform beam forming. The mid and low frequency signals are added to the low frequency effect channel and provided to a woofer to reproduce a low frequency band.

However, although the conventional technology illustrated in FIG. 1A improves the performance of high frequency beam forming, it degrades a surround sound stereo effect because mid and low frequency band signals are not beam-formed. Also, the conventional front surround sound reproduction system cannot experience the surround sound stereo effect in a listening space having one side open without a wall as illustrated in FIG. 1B, because a reflection of a high frequency signal by a wall rarely exists.

SUMMARY OF THE INVENTION

The present general inventive concept provides a front surround sound reproduction system to improve a stereo effect of mid and low frequency signals by using psychoacoustic models and to improve a performance of the system in a listening space, and a method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a front surround sound reproduction system to reproduce multi-channel audio signals by using a plurality of speakers, including a split unit to copy multi-channel signals into two groups of multi-channel signals, a virtual sound processing unit to generate a virtual sound signal based on a head related transfer function (HRTF) from one of the two groups of multi-channel signals, a beam forming processing unit to generate a sound beam signal by adjusting delays and levels of the other one of the two groups of multi-channel signals, and a crossover network unit to adjust the characteristics of the virtual sound signal and the sound beam signal generated in the virtual sound processing unit and the beam forming processing unit, respectively, and to provide the adjusted virtual sound signal and the adjusted sound beam signal to a mid and low frequency speaker array and a high frequency speaker array, respectively.

The foregoing and/or other aspects and utilities of the present general inventive concept may be achieved by providing a method of reproducing multi-channel audio signals in a front surround sound reproduction system, the method including copying multi-channel signals into two groups of multi-channel signals, generating a virtual sound signal corresponding to an HRTF from one of the two split groups of multi-channel signals, generating a sound beam signal by adjusting delays and levels of the other one of the two split groups of multi-channel signals, and adjusting the characteristics of the virtual sound signal and the adjusted sound beam signal, respectively, and providing the virtual sound signal and the adjusted sound beam signal to a mid and low frequency speaker array and a high frequency speaker array, respectively.

The foregoing and/or other aspects and utilities of the present general inventive concept may be achieved by providing a front surround sound reproduction system to reproduce multi-channel audio signals by using a plurality of speakers, including a crossover network unit to adjust a level of a plurality of 2-channel PCM signals and to change a frequency of the plurality of 2-channel PCM signals to fit characteristics of mid and low frequency middle aperture speakers, and to adjust a level of a plurality of 5-channel PCM signals and to change a frequency of the plurality of 5-channel PCM signals to fit characteristics of high frequency small aperture speakers.

The foregoing and/or other aspects and utilities of the present general inventive concept may be achieved by providing a front surround sound reproduction system to reproduce multi-channel audio signals by using a plurality of speakers, including a crossover network unit to adjust gains and delays of a plurality of 2-channel signals and a plurality of N-channel signals, to low-pass filter the plurality of 2-channel signals to fit characteristics of a mid and low frequency speaker, and to high-pass filter the plurality of N-channel signals to fit characteristics of a high frequency speaker array.

The foregoing and/or other aspects and utilities of the present general inventive concept may be achieved by providing a computer readable recording medium having embodied thereon a computer program to execute a method, wherein the method includes copying multi-channel signals into two groups of multi-channel signals, generating a virtual sound signal corresponding to an HRTF from one of the two split groups of multi-channel signals; generating a sound beam signal by adjusting delays and levels of the other one of the two split groups of multi-channel signals, and adjusting characteristics of the virtual sound signal and the sound beam signal, respectively, and providing the virtual sound signal and the sound beam signal to a mid and low frequency speaker and a high frequency speaker array, respectively.

The foregoing and/or other aspects and utilities of the present general inventive concept may be achieved by providing a front surround sound reproduction system, including a split unit to generate two groups of multi-channel signals, a virtual sound processing unit to generate a virtual sound signal from one of the two groups of multi-channel signals according to an HRTF, a beam forming processing unit to generate a sound beam signal from the other one of the two groups of multi-channel signals, and a crossover network unit to process two signals of the virtual sound signal, and to process N-channel signals of the sound beam signal.

The front surround sound reproduction system may further include a mid and low frequency speaker to generate sound according to the processed two signals, and a high frequency speaker array to generate sound according to the processed N-channel signals.

The mid and low frequency speaker and the high frequency speaker array may include front speakers.

The two signals of the virtual sound signal may include two PCM signals, and the N-channel signals of the sound beam signal may include N-channel PCM signals.

Each of the two groups of multi-channel signals may include a left channel signal, a right channel signal, a low frequency effect channel signal, a center channel signal, a left surround channel signal, and a right surround channel signal.

The virtual sound processing unit may process the left channel signal, the right channel signal, the low frequency effect channel signal, and the center channel signal to generate left and right signals, may process the left surround channel signal and the right surround channel signal to generate first and second virtual sound sources, and may generate audio signals according to the left and right signals and the first and second virtual sound sources.

The front surround sound reproduction system may further include left and right speakers to generate sound according to the respective audio signals.

The beam forming processing unit may process the left channel signal, the right channel signal, and the left surround channel signal to generate N-channel signals as the sound beam signal.

The front surround sound reproduction may further include a high frequency speaker array to generate sound according to N-channel signals.

The foregoing and/or other aspects and utilities of the present general inventive concept may be achieved by providing a front surround system, including a processing unit to process multi-channel signals to generate a virtual sound signal, and to process the multi-channel signals to generate a sound beam signal, and a crossover network to process the virtual sound signal to generate left and right speaker signals, and to process the sound beam signal to generate N-signals to generate a high frequency speaker signal.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
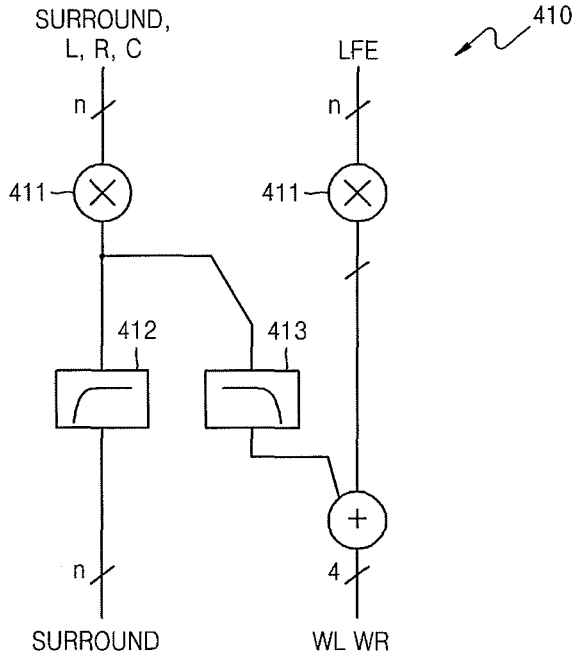
FIG. 1A (PRIOR ART)
FIG. 1A is block diagram of a conventional front surround sound reproduction system.
Figure 1B:
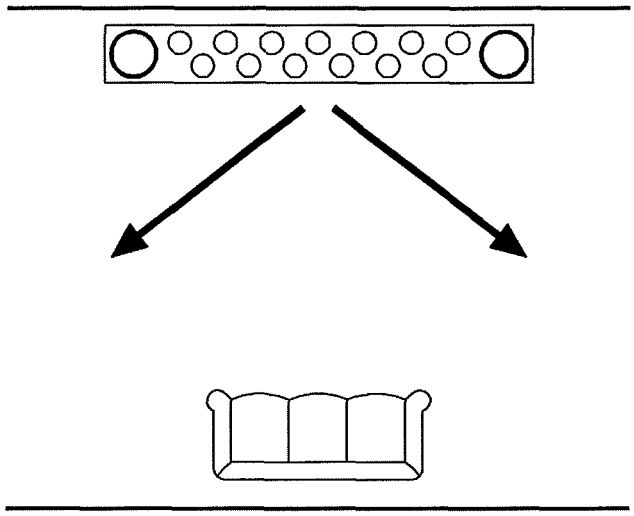
FIG. 1B (PRIOR ART)
FIG. 1B is a diagram illustrating the generation of sound in the conventional front surround sound reproduction system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
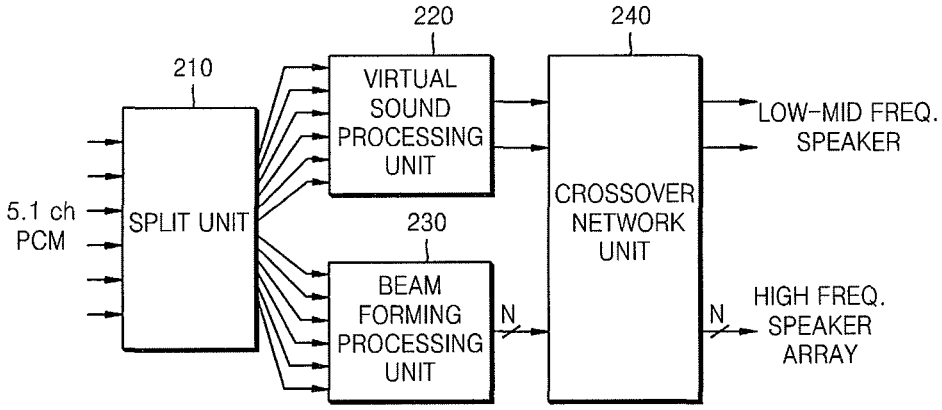
FIG. 2 is a block diagram of a structure of an entire front surround sound reproduction system according to an embodiment of the present general inventive concept.

FIG. 2 is a block diagram of a structure of an entire front surround sound reproduction system according to an embodiment of the present general inventive concept.

The front surround reproduction system of FIG. 2 includes a split unit 210, a virtual sound processing unit 220, a beam forming processing unit 230, and a crossover network unit 240.

A pulse code modulation (PCM) signal of 5.1 channel signals, that is, left (L), right (R), center (C), left surround (Ls), right surround (Rs), and low frequency effect (LFE) channel signals, is input. In the current embodiment of the present general inventive concept, an example of 5.1 channels is described, but it is clear to those skilled in the art of the present general inventive concept that the current embodiment can also be applied to other multi channels, such as 6.1 channels and 7.1 channels. Also, a beam forming processing technology according to the current embodiment provides twisting directivities by sequentially outputting signals having predetermined delays to respective speakers in a speaker array. Here, the twisting angles can be adjusted arbitrarily according to the degree of delays.

The split unit 210 copies the input multi-channel signal, that is, the 5.1-channel PCM signal, and separates the signal into two groups of multi-channel signals (6 channels+6 channels) to perform virtual sound and beam forming.

The virtual sound processing unit 220 generates a virtual sound signal from the one group of the multi-channel PCM signals, i.e., the 5.1 channel PCM signals, split in the split unit 210 by applying a psychoacoustic model. The psychoacoustic model may include a filter based on a head related transfer function (HRTF). This HRTF contains a large amount of information indicating characteristics of a space through which sound is transmitted, including an inter-aural time difference, an inter-aural level difference, and the shape of a pinna, i.e., the visible part of the ear that resides outside of the head. In particular, the HRTF includes information on the pinna, which has a critical influence on the localization of upper and lower sound images. Since modeling of the pinna is difficult, it is obtained mainly through measuring.

The beam forming processing unit 230 generates an N-channel sound beam signal from the other group of the multi-channel PCM signals, i.e., the 5.1 channel PCM signals, split in the split unit 210, by adjusting the delays and levels of the multi-channel signals. Accordingly, the beam forming processing unit 230 generates a surround sound stereo effect, by making the input signal have different directivities with respect to each channel.

It is difficult for the low frequency effect (LFE) channel signal to have directivity due to a physical characteristic of the channel, and the LFE channel signal may damage a high frequency speaker. Accordingly, the beam forming processing unit 230 does not process beam forming for the low frequency effect (LFE) channel signal.

The crossover network unit 240 adjusts characteristics of the virtual sound signal generated in the virtual sound processing unit 220 and the sound beam signal generated in the beam forming processing unit 230, and provides the virtual sound signal and the sound beam signal to a mid and low frequency speaker and a high frequency speaker array, respectively.

Figure 3:
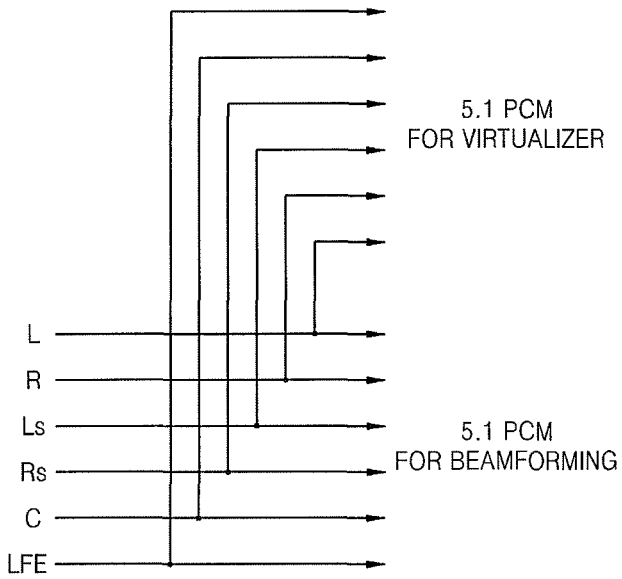
FIG. 3 illustrates a split unit illustrated in FIG. 2 according to an embodiment of the present general inventive concept.

FIG. 3 illustrates the split unit 210 illustrated in FIG. 2 according to an embodiment of the present general inventive concept.

Referring to FIG. 3, the left (L), right (R), center (C), left surround (Ls), right surround (Rs), and low frequency effect (LFE) channel signals are copied into two groups of identical signals by a predetermined copying circuit. At this time, a known technology, such as a buffer, can be used for a copying circuit of the split unit 210. Accordingly, the left (L), right (R), center (C), left surround (Ls), right surround (Rs), and low frequency effect (LFE) channel signals are provided to the beam forming processing unit 230 of FIG. 2 and the copied signals are provided to the virtual sound processing unit 220 of FIG. 2.

Figure 4:
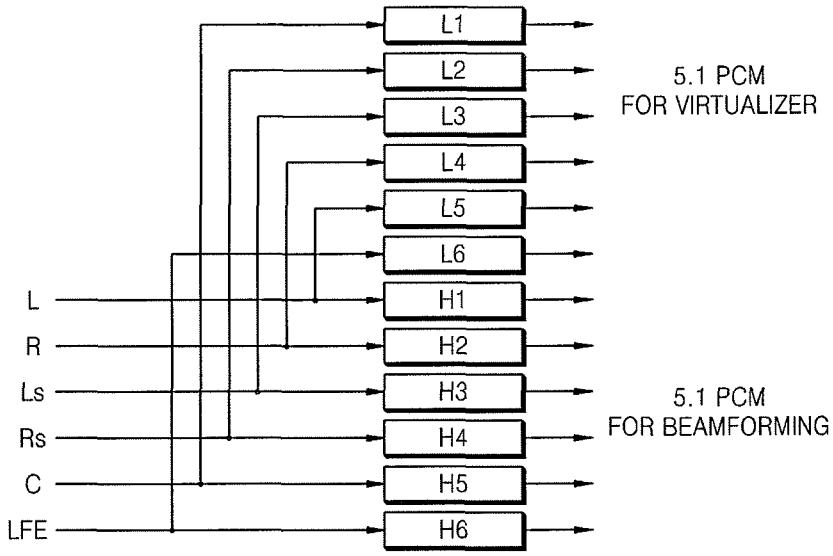
FIG. 4 illustrates the split unit illustrated in FIG. 2 according to another embodiment of the present general inventive concept.

FIG. 4 illustrates the split unit 210 illustrated in FIG. 2 according to another embodiment of the present general inventive concept.

Referring to FIG. 4, the left (L), right (R), center (C), left surround (Ls), right surround (Rs), and low frequency effect (LFE) channel signals are separated into two groups of multi-channel signals by low pass filters (L1-L6) and high pass filters (H1-H6). Accordingly, the low pass filters (L1-L6) remove high frequency components of the left (L), right (R), center (C), left surround (Ls), right surround (Rs), and low frequency effect (LFE) channel signals which are to be provided to the beam forming processing unit 230 of FIG. 2, and the high pass filters (H1-H6) remove low frequency components of the left (L), right (R), center (C), left surround (Ls), right surround (Rs), and low frequency effect (LFE) channel signals which are to be provided to the virtual sound processing unit 220 of FIG. 2.

Figure 5:
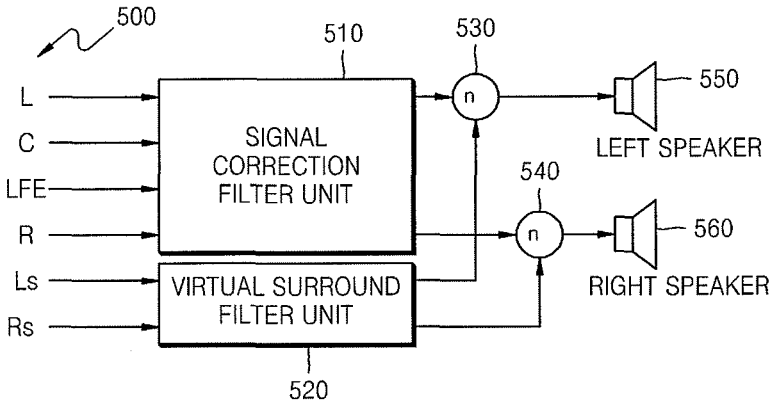
FIG. 5 is a view illustrating virtual sound processing unit illustrated in FIG. 2 according to an embodiment of the present general inventive concept.

FIG. 5 is a view illustrating the virtual sound processing unit 220 illustrated in FIG. 2, according to an embodiment of the present general inventive concept.

The virtual sound processing unit 220 illustrated in FIG. 5 includes a virtual surround filter unit 520, a signal correction filter unit 510, a first addition unit 530, a second addition unit 540, a left channel speaker 550, and a right channel speaker 560.

Multi-channel audio signals 500 include the left (L), center (C), low frequency effect (LFE), right (R), left surround (Ls), and right surround (Rs) channel signals that are split in the split unit 210 of FIG. 2. The current embodiment of the present general inventive concept describes a 5.1 channel configuration, but those of ordinary skill in the art can apply the current embodiment of the present general inventive concept to other multi channels, such as 6.1 channels and 7.1 channels.

The virtual surround filter unit 520 receives the inputs of the left surround (Ls) and right surround (Rs) channel signals among the multi-channel audio signals 500.

The virtual surround filter unit 520 lowers the correlation between the input left surround (Ls) and right surround (Rs) channel signals, generates an envelopment effect, and generates virtual sound sources at a left-rear and a right-rear of a listener.

For example, the virtual surround filter unit 520 may include a preprocessing filter and a virtual speaker filter. The preprocessing filter lowers the correlation of the input left surround (Ls) and right surround (Rs) channel signals to generate a correct localization effect of surround channel sound and the envelopment effect. If the correlation between the left surround (Ls) and right surround (Rs) channel signals is high, the sound image is generated at the center-rear of the listener as a phantom sound image, instead of the left-rear and right-rear of the listener. Accordingly, the sound image may be moved again to a front of the listener due to a front/back confusion phenomenon, which results in a degraded surround sound for the listener. Accordingly, the preprocessing filter lowers the correlation between the left surround (Ls) and right surround (Rs) channel signals, generates an envelopment effect, and thus generates a natural surround sound channel effect. The virtual speaker filter receives a signal output from the preprocessing filter, and by using an HRTF, arranges virtual sound sources at the left-rear and right-rear of the listener so that a stereo effect can be generated.

The signal correction filter unit 510 receives the inputs of the left (L), center (C), low frequency effect (LFE), and right (R) channel signals from among the multi-channel audio signals 500.

Gains of the left surround (Ls) and right surround (Rs) channel signals that are output through the virtual surround filter unit 520 change, and time delays of the signals occur.

The signal correction filter unit 510 adjusts the gains and time delays of the left (L), center (C), low frequency effect (LFE), and right (R) channel signals to suit the output gains and time delays of the left surround (Ls) and right surround (Rs) channel signals.

The first and second addition units 530 and 540 add left channel signals and right channel signals, respectively, that are output from the virtual surround filter unit 520 and the signal correction filter unit 510. Then, the added left channel signals are output to the left channel speaker 550 and the added right channel signals are output to the right channel speaker 560.

Figure 6:
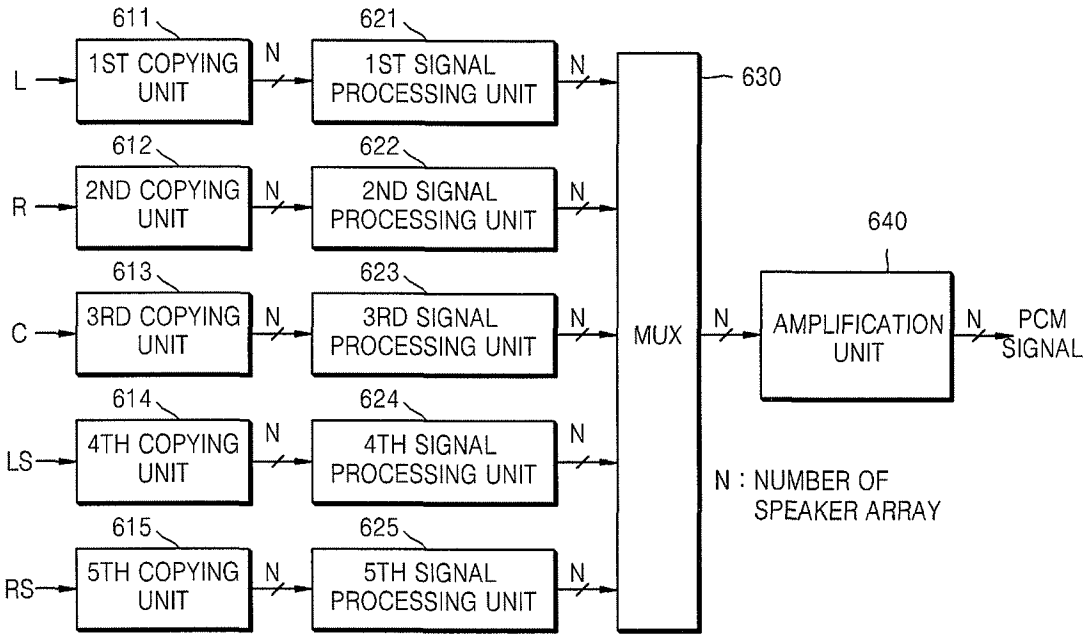
FIG. 6 is a detailed diagram of a beam forming processing unit illustrated in FIG. 2 according to an embodiment of the present general inventive concept.

FIG. 6 is a detailed diagram of the beam forming processing unit 230 illustrated in FIG. 2, according to an embodiment of the present general inventive concept.

The beam forming processing unit 230 may include first through fifth copying units 611 through 615 to receive the inputs of the left (L), center (C), right (R), left surround (Ls) and right surround (Rs) channel signals, respectively, split in the split unit 210 of FIG. 2. At this time, a low frequency effect (LFE) channel signal is excluded from a beam forming process since the LFE channel signal has a low beam forming effect.

The first through fifth copying units 611 through 615 make a number of copies of the left (L), center (C), right (R), left surround (Ls) and right surround (Rs) channel signals, respectively, as equal to the number of speakers in the speaker array. For example, if the number of the speakers in the speaker array is N, the left (L), center (C), right (R), left surround (Ls) and right surround (Rs) channel signals are copied into N channel signals, respectively, ($L_1$-$L_n$, $R_1$-$R_n$, $C_1$-$C_n$, $Ls_1$-$Ls_n$, $Rs_1$-$Rs_n$).

A first signal processing unit through a fifth signal processing unit 621-625 amplify or delay the copied N channel signals ($L_1$-$L_n$, $R_1$-$R_n$, $C_1$-$C_n$, $Ls_1$-$Ls_n$, $Rs_1$-$Rs_n$), respectively, which are copied in the first through fifth copying units 611 through 615. For example, the first signal processing unit 621 applies different gains to the N channel signals ($L_1$-$L_n$), respectively, which are copied in the first copying unit 611, and sequentially amplifies the signals, or applies different delays to the N channel signal ($L_1$-$L_n$) in order to delay the signals sequentially. Accordingly, the first through fifth signal processing unit 621 through 625 sequentially generate signals having predetermined delays and gains so that twisting directivities can be provided. At this time, the twisted angles are arbitrarily adjusted according to the quantity of delay.

A multiplexer (MUX) 630 multiplexes the channel signals ($L_1$-$L_n$, $R_1$-$R_n$, $C_1$-$C_n$, $Ls_1$-$Ls_n$, $Rs_1$-$Rs_n$) processed in the first through fifth signal processing units 621 through 625, respectively, and outputs an N-channel PCM signal. For example, if the number of the speakers in the speaker array is N, each multiplexer signal can be expressed as $S_1+S_2+S_3+\ldots S_n$, and $S_n=L_n+R_n+C_n+LS_n+RS_n$.

An amplification unit 640 adjusts the gain of each of the N channel signals multiplexed in the multiplexer unit 630 so that a sharper directivity can be achieved. The amplification unit 640 may apply a beam forming window to the multiplexed N channel signals.

Figure 7:
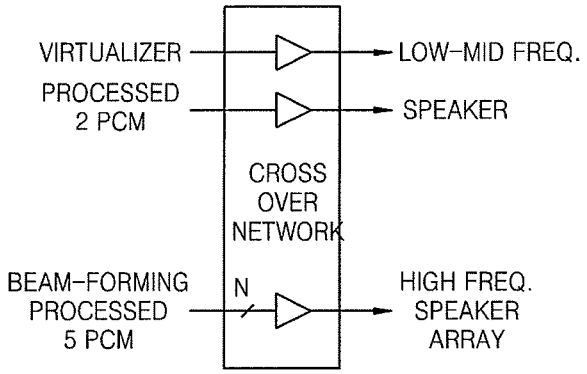
FIG. 7 is a crossover network unit illustrated in FIG. 2 according to an embodiment of the present general inventive concept.

FIG. 7 is a view illustrating the crossover network unit 240 illustrated in FIG. 2 according to an embodiment of the present general inventive concept.

The crossover network unit 240 adjusts the level of virtualizer processed 2 PCM signals, that is, 2-channel PCM signals and changes a frequency component of 2-channel PCM signals processed in the virtual sound processing unit 220 of FIG. 2 to allow the 2-channel PCM signals to fit characteristics of mid and low frequency middle aperture speakers. Also, the crossover network unit 240 adjusts a level of 5 a beam-forming processed 5 PCM signal, that is, 5 channel PCM signals, and changes a frequency component of the 5 channel PCM signals processed in the beam forming processing unit 230 of FIG. 2, to allow the 5 channel PCM signals to fit a characteristic of an array of high frequency small aperture speakers, when N is 5. That is, the 2-channel PCM signals processed in the virtual sound processing unit 220 are converted to fit the characteristics of the mid and low frequency middle aperture speakers and to output to the mid and low frequency middle aperture speakers, and the 5 channel PCM signals processed in the beam forming processing unit 230 are converted to fit the characteristics of high frequency speakers and to output to the high frequency small aperture speaker array.

An example of a high frequency band speaker that can be applied to the present embodiment may be a speaker with about a 2-inch diameter capable of outputting or reproducing a signal with a frequency range of 100 Hz to 10,000 Hz without degradation of sound quality. Also, an example of a low frequency band speaker may be a speaker with about a 4-inch diameter capable of outputting or reproducing a signal with a frequency range of 10 Hz to 500 Hz without degradation of sound quality.

Figure 8:
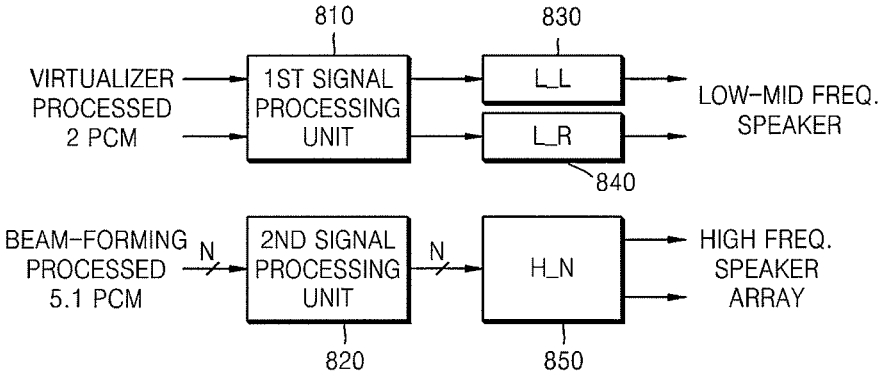
FIG. 8 is the crossover network unit illustrated in FIG. 2 according to another embodiment of the present general inventive concept.

FIG. 8 is the crossover network unit 240 illustrated in FIG. 2 according to another embodiment of the present general inventive concept.

Referring to FIG. 8, the 2-channel PCM signals processed in the virtual sound processing unit 220 are output to the mid and low frequency speaker through a first signal processing unit 810 and left and right low pass filters 830 and 840.

The first signal processing unit 810 can control tonal balance by adjusting gains and delays of the 2-channel PCM signals processed in the virtual sound processing unit 220. Also, the first signal processing unit 810 can further improve a stereo sound effect and audio quality by adjusting the gain values with respect to characteristics of an input signal or a sound reproduction space. The left and right low pass filters 830 and 840 low pass filter the 2-channel PCM signals that are processed in the first signal processing unit 810 to fit characteristics of the mid and low frequency speaker, and output the signals to the mid and low frequency speaker. Accordingly, the left and right low pass filters 830 and 840 can improve the tonal balance by adjusting a cut-off frequency and filter order.

Here, the cut-off frequency is determined by considering the performances of the beam forming processing unit 230 and the virtual sound processing unit 220.

To guarantee adequate performance of the beam forming, a wavelength of a sound signal desired to be reproduced should be longer than twice a total length of a speaker array. Also, the virtual sound processing unit 220 generally processes a signal having a frequency of equal to or less than 1.5 kHz, considering an inter-aural time difference (ITD) that is a time difference between times taken by signals arriving at two ears from an identical sound source. As an embodiment, if a speaker array with a length of about 60 cm is arranged with a 50-inch screen with a length of 100 cm, excluding a space for mid and low frequency speaker, the cut-off frequency can be set to 2 kHz.

The N-channel PCM signals that are processed in the beam forming processing unit 230 are output to the high frequency band speaker array through a second signal processing unit 820 and a high pass filter 850.

The second signal processing unit 820 can control tonal balance and can synchronize the signals by adjusting the gains and delays of the N-channel signals processed in the beam forming processing unit 230. Also, the second signal processing unit 820 can further improve a stereo sound effect and audio quality by adjusting the gain values with respect to the characteristics of an input signal or a sound reproduction space. The high pass filter 850 high pass filters the N-channel PCM signals processed in the second signal processing unit 820 in order to fit the characteristics of the high frequency speaker array, and outputs the signals to the high frequency speaker array. The high pass filter 850 can improve the tonal balance by adjusting a cut-off frequency and filter order.

Also, the first and second signal processing units 810 and 820 compensate for the magnitudes and phase delay differences of the mid and low frequency signals and the high frequency signals that are changed through the virtual sound processing unit 220 and the beam forming processing unit 230, respectively.

Synchronization of signals to be reproduced in the mid and low frequency speakers and the high frequency speakers can be performed and frequency characteristics close to those of the original sound can be generated.

The magnitudes of the mid and low frequency signals and the high frequency signals can be calculated on the basis of a root mean square (RMS).

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the present general inventive concept as described above, in a front surround signal reproducing system having a speaker array, a psychoacoustic filter is applied to mid and low frequency signals of surround channels for which beam forming is not performed. By doing so, a surround sound stereo effect can be achieved in a signal reproduced in the mid and low frequency speakers positioned in front of the listener. Accordingly, the front surround signal reproduction system adds a stereo effect to the signal reproduced in the mid and low frequency speakers so that the stereo effect can be generated in the entire frequency bands.

Also, the present invention passes the mid and low frequency signals through the 2-channel virtual sound generation unit so that the stereo effect can be improved even in a space where sound is difficult to reflect.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A front surround sound reproduction system to reproduce multi-channel audio signals by using a plurality of speakers, comprising:

a split unit to copy multi-channel signals into two groups of multi-channel signals;

a virtual sound processing unit to generate a virtual sound signal corresponding to a head related transfer function (HRTF) from one group of the multi-channel signals;

a beam forming processing unit to generate a sound beam signal by adjusting delays and levels of the other group of the multi-channel signals; and a crossover network unit to adjust a level and to change a frequency component of the virtual sound signal and the sound beam signal generated in the virtual sound processing unit and the beam forming processing unit, respectively, and to provide the adjusted virtual sound signal and the adjusted sound beam signal to a mid and low frequency speaker array and a high frequency speaker array, respectively, the crossover network unit comprising:

a first signal processing unit to adjust gains and delays of 2-channel signals of the virtual sound signal processed in the virtual sound processing unit;

a low pass filter to low pass filter the 2-channel signals processed in the first signal processing unit and to output the filtered 2-channel signals to the mid and low frequency speaker array;

a second signal processing unit to adjust gains and delay of N-channel signals of the sound beam signal processed in the beam forming processing unit; and a high pass filter to high pass filter the N-channel signals processed in the second signal processing unit and to output the filtered N-channel signals to the high frequency speaker array.

2. The system of claim 1, wherein the split unit comprises:

a second low pass filter to remove high frequency components from the multi-channel signals to generate the one split group; and a second high pass filter to remove low frequency components from the multi-channel signals to generate the other split group.

3. The system of claim 1, wherein the virtual sound processing unit comprises:

a virtual surround filter unit to lower a correlation between left and right channel audio signals among the signals of the one split multi-channel signal group, and converting the left and right channel audio signals into a virtual sound source, by applying the HRTF;

a signal correction filter unit to correct signal characteristics between remaining channel audio signals of the one split multi-channel signal group except the left and right surround channel signals and to output the corrected signals as left and right channel signals; and an addition unit to add the left channel signal output from the signal correction filter unit and the virtual sound source of the left channel audio signal output from the virtual surround filter unit, and to add the right channel signal output from the signal correction filter unit and the virtual sound source of the right channel signal output from the virtual surround filter unit.

4. The system of claim 1, wherein the beam forming processing unit comprises:

a signal copying unit to copy each of the multi-channel signals split in the split unit into N signals, N corresponding to a number of speakers in the speaker array;

a third signal processing unit to sequentially amplify and delay the N signals in each of the multi-channel signals; and a multiplexer unit to multiplex the amplified and delayed N signals and to output the N-channel signals.

5. The system of claim 1, wherein the beam forming processing unit further comprises:

an amplification unit to adjust a gain of each of the N channel signals multiplexed in the multiplexer unit.

6. The system of claim 5, wherein the amplification unit applies a beam forming window.

7. A method of reproducing multi-channel audio signals in a front surround sound reproduction system, the method comprising:

copying multi-channel signals into two groups of multi-channel signals;

generating a virtual sound signal corresponding to an HRTF from one group of the multi-channel signals;

generating a sound beam signal by adjusting delays and levels of the other group of the multi-channel signals;

adjusting gains and delays of 2-channel signals of the virtual sound processing unit in the virtual sound processing unit;

low pass filtering the 2-channel signals and outputting the filtered 2-channel signals to the mid and low frequency speaker array;

adjusting gains and delays of N-channel signals of the sound beam signal; and high pass filtering the N-channel signals and outputting the filtered N-channel signals to the high frequency speaker array.

8. The method of claim 7, wherein the copying and splitting of the multi-channel signals comprises:

changing frequency characteristics of input multi-channel signals in order to copy the multi-channel signals.

9. The method of claim 7, wherein the generating of the sound beam signal comprises:

copying each of the split multi-channel signals into N signals, N corresponding to a number of speakers in the speaker array;

sequentially amplifying and delaying the N signals in each of the multi-channel signals; and multiplexing the processed N signals, and outputting the N-channel signals.

10. The method of claim 7, wherein the generating of the virtual signal comprises:

converting left surround channel signal and right surround channel signal of one of the two split groups of multi-channel signals into virtual sound sources, by applying the HRTF;

correcting signal characteristics between remaining channel audio signals of the one of the two split groups of multi-channel signals, except the left surround channel signal and the right surround channel signal, and outputting the corrected signals as left and right channel signals; and generating a stereo-channel signal by combining the virtual sound sources and the corrected signals.

11. A non-transitory computer readable recording medium having embodied thereon a computer program to execute a method, wherein the method comprises:

copying multi-channel signals into two groups of multi-channel signals;

generating a virtual sound signal corresponding to an HRTF from one group of the multi-channel signals;

generating a sound beam signal by adjusting delays and levels of the other group of the multi-channel signals;

adjusting gains and delays of 2-channel signals of the virtual sound processed in the virtual sound processing unit;

low pass filtering of the 2-channel signals and outputting 2-channel signals to the mid and low frequency speaker array;

adjusting gains and delays of N-channel signals of the sound beam signal; and high pass filtering the N-channel signals and outputting the filtered N-channel signals to the frequency speaker array.

12. A front surround sound reproduction system, comprising:

a split unit to generate two groups of multi-channel signals;

a virtual sound processing unit to generate a virtual sound signal from one group of the multi-channel signals according to an HRTF;

a beam forming processing unit to generate a sound beam signal from the other group of the multi-channel signals; and a crossover network unit to adjust a level and to change a frequency component of the virtual sound signal, and to adjust a level and to change a frequency component of the sound beam signal, the crossover network unit comprising:

a first signal processing unit to adjust gains and delays of 2-channel signals of the virtual sound signal processed in the virtual sound processing unit;

a low pass filter to low pass filter the 2-channel signals to a mid and low frequency speaker array;

a second signal processing unit to adjust gains and delays of N-channel signals of the sound bean signal processed in the beam forming processing unit; and a high pass filter to high pass filter the N-channel signals processed in the second signal processing unit and to output the filtered N-channel signals to a high frequency speaker array.

13. The front surround sound reproduction system of claim 12, further comprising:

the mid and low frequency speaker array to generate sound according to the filtered 2-channel signals; and the high frequency speaker array to generate sound according to the filtered N-channel signals.

14. The front surround sound reproduction system of claim 12, wherein the mid and low frequency speaker and the high frequency speaker array comprises front speakers.

15. The front surround sound reproduction system of claim 12, wherein the 2-channel signals of the virtual sound signal comprises two PCM signals, and the N-channel signals of the sound beam signal comprises N-channel PCM signals.

16. The front surround sound reproduction system of claim 12, wherein each of the two groups of multi-channel signals comprises a left channel signal, a right channel signal, a low frequency effect channel signal, a center channel signal, a left surround channel signal, and a right surround channel signal.

17. The front surround sound reproduction system of claim 16, wherein the virtual sound processing unit processes the left channel signal, the right channel signal, the low frequency effect channel signal, and the center channel signal to generate left and right signals, processes the left surround channel signal and the right surround channel signal to generate first and second virtual sound sources, and generates audio signals according to the left and right signals and the first and second virtual sound sources.

18. The front surround sound reproduction system of claim 17, further comprising:

left and right speakers to generate sound according to the respective audio signals.

19. The front surround sound reproduction system of claim 16, wherein the beam forming processing unit processes the left channel signal, the right channel signal, and the left surround channel signal to generate the N-channel signals as the sound beam signal.

20. The front surround sound reproduction system of claim 19, further comprising:

a high frequency speaker array to generate sound according to the N-channel signals.

* * * * *